US005787960A

United States Patent [19]

Schmitt

[11] Patent Number: 5,787,960

[45] Date of Patent: Aug. 4, 1998

[54] METHOD OF MAKING METAL MATRIX COMPOSITES

[75] Inventor: Theodore Schmitt, Vienna, Austria

[73] Assignee: Electrovac, Fabrikation Elektrotechnischer Spezialartikel Gesellschaft m.b.H., Klosterneuburg, Austria

[21] Appl. No.: 816,407

[22] Filed: Mar. 13, 1997

Related U.S. Application Data

[63] Continuation of Ser. No. 387,042, Feb. 9, 1995, abandoned.

[30] Foreign Application Priority Data

Feb. 10, 1994 [AT] Austria ..... 258/94

[51] Int. Cl.[6] ..... B22D 18/00; B22D 19/14; B22D 27/09

[52] U.S. Cl. ..... 164/66.1; 164/97; 164/98; 164/120

[58] Field of Search ..... 164/97, 98, 120, 164/66.1, 319, 259, 68.1, 80, 284, 285

[56] References Cited

U.S. PATENT DOCUMENTS

| | | | |
|---|---|---|---|
| 3,547,180 | 12/1970 | Cochran et al. | 164/97 |
| 3,853,635 | 12/1974 | Demendi | 164/97 |
| 4,769,071 | 9/1988 | Klar et al. . | |
| 4,889,177 | 12/1989 | Charbonnier et al. | 164/97 |
| 4,947,924 | 8/1990 | Morita et al. | 164/97 |
| 5,002,115 | 3/1991 | Noordegraaf et al. | 164/97 |
| 5,007,475 | 4/1991 | Kennedy et al. . | |
| 5,020,584 | 6/1991 | Aghajanian . | |
| 5,058,653 | 10/1991 | Garat | 164/120 |
| 5,111,870 | 5/1992 | Cook . | |
| 5,165,463 | 11/1992 | Aghajanian et al. | 164/97 |
| 5,172,746 | 12/1992 | Corwin | 164/97 |
| 5,234,045 | 8/1993 | Cisko | 164/97 |
| 5,261,477 | 11/1993 | Brunet et al. | 164/97 |
| 5,301,739 | 4/1994 | Cook | 164/97 |
| 5,348,071 | 9/1994 | Cook | 164/97 |

FOREIGN PATENT DOCUMENTS

| | | | |
|---|---|---|---|
| 0062496 | 10/1982 | European Pat. Off. . | |
| 0296074 | 12/1988 | European Pat. Off. . | |
| 0365978 | 5/1990 | European Pat. Off. . | |
| 0388235 | 9/1990 | European Pat. Off. . | |
| 0409197 | 1/1991 | European Pat. Off. . | |
| 58-84661 | 5/1983 | Japan | 164/284 |
| 59-166361 | 9/1984 | Japan . | |
| 60-191654 | 9/1985 | Japan . | |
| 1263925 | 2/1972 | United Kingdom . | |
| 1276571 | 6/1972 | United Kingdom . | |
| 1331728 | 9/1973 | United Kingdom . | |
| 2115327 | 9/1983 | United Kingdom . | |
| 2150867 | 7/1985 | United Kingdom . | |
| 2247636 | 3/1992 | United Kingdom . | |
| WO90/08610 | 8/1990 | WIPO . | |

*Primary Examiner*—J. Reed Batten, Jr.
*Attorney, Agent, or Firm*—Henry M. Feiereisen

[57] ABSTRACT

A preform of reinforcement material is infiltrated with fusible metal without preceding vacuum treatment of the preform through gas pressure application solely. The infiltrated preform is allowed to solidify under pressure.

15 Claims, 2 Drawing Sheets

METHOD OF MAKING METAL MATRIX COMPOSITES

This is a continuation of application Ser. No. 08/387,042, filed Feb. 9, 1995 and now abandoned.

BACKGROUND OF THE INVENTION

The present invention refers to a method of making metal matrix composites as well as to an apparatus for carrying out the method.

Metal matrix composites (MMC) are products in which a metal and a non-metallic reinforcement material are embedded within each other at different quantitative proportion. The reinforcement material may be provided in form of particles, fibers or porous bodies, surrounded and infiltrated by metal. Depending on the selected type, shape, quantity and porosity of the reinforcement material as well as the selected type of infiltration metal the mechanical, electrical, and thermal properties of the finished product can be best suited to required demands.

It is known to make a MMC product through permeation of a fusible metal into a porous body of reinforcement material. In general, the desired products of MMC material are manufactured directly in the form of the desired molded part. The preforms are initially treated in a vacuum and subsequently infiltrated by the fusible metal at elevated temperature and application of pressure. The cooling is carried out always under pressure since the wetting capability of the metal upon the reinforcement material is generally poor so that the still liquid metal would escape from the preform during the cooling step without application of pressure.

In general, a single apparatus, e.g. in form of a pressure vessel, is used to carry out this method. Thus, the apparatus must be vacuum-tight as well as pressure-tight. During pretreatment at vacuum conditions, the applied underpressure is generally in the magnitude of 0.1 mbar to 0.01 mbar. During infiltration, the gas pressure may amount to more than 100 MPa. The pressure vessel is thus subjected to a significant pressure difference. In addition, the pressure vessel must be provided with a heating unit in order to reach the required melting temperatures of the used metals.

Such multifunctional pressure vessels are of complicated structure, very cost intensive and susceptible to failure so that the manufacturing costs for MMC products become extremely high.

SUMMARY OF THE INVENTION

It is an object of the present invention to provide an improved method of making metal matrix composites, obviating the afore-stated drawbacks.

In particular, it is an object of the present invention to provide an improved method of making metal matrix composites which can be carried out in a highly efficient and cost-effective manner and yet is reliable without being susceptible to failure.

It is yet another object of the present invention to provide an improved apparatus for carrying out the method.

These objects, and others which will become apparent hereinafter, are attained in accordance with the present invention by permeating fusible metal into the preform of a reinforcement material without preceding vacuum treatment through application of gas pressure solely, and allowing the forming composite to cool off under pressure.

By melting the fusible metal onto the pre form of reinforcement material without preceding vacuum treatment, simply by application of a gas pressure, the entire vacuum plant can be omitted so that the overall process runs in one step. The advantages of such a method are thus significant.

According to one embodiment of the present invention, the preform is received in a mold of porous material which absorbs gas escaping from the preform at metal infiltration during pressure treatment. Suitably, the mold is made of graphite or porous ceramics and is generally suitable for one time use only.

According to another embodiment of the present invention, the preform is received in a mold of steel or gastight ceramics, such as e.g. aluminum titanate. If desired, the mold may also contain elements of a porous material. The particular advantage of such preform molds is their ability of being reusable. Steel and aluminum titanate are not porous and the gas remains in the preform. The amount of trapped gas can be calculated according to the gas law for ideal gas which is expressed by the following equation:

$$pV=nRT$$

wherein p is the pressure, V is the gas volume, n is the number of mole, R is the universal gas constant ($R=8.31441$ J $mol^{-1}$ $K^{-1}$), T is the temperature. Taking into account the pressure and the temperature applied during the method according to the present invention, it can be calculated that the trapped gas volume in the preform totals not even 0.5% of the entire volume in the end product. Thus, the trapped gas volume is negligible especially since the finished products are rarely subjected to a significant mechanical load such as tension, pressure or flexure. However, if an even smaller gas volume is desired, e.g. demand for increased homogeneity, the mold may be provided with elements of porous material for gas absorption.

The calculation in accordance with the previously expressed equation for the gas law can be based on the following exemplified parameters:

Preform size: 2.54×2.54 cm, thickness 0.1 cm

Porosity of the preform: 30% by volume;

Infiltration temperature: 700° C.;

Infiltration pressure: 70 bar.

When calculating the trapped gas volume based on above-stated parameters, the formed product (e.g. a plate) has after termination of the method an overall volume of about 645 $mm^3$, with a residual gas volume of 2.81 $mm^3$. Accordingly, the trapped gas volume amounts to about 0.43% of the overall plate volume. For comparison, the amount of trapped gas volume would theoretically correspond to a cube with an edge length of 1.41 mm, or to a sphere with a diameter of 1.75 mm.

The pressure applied during infiltration generally ranges between 60 bar to 140 bar, preferably from 60 bar to 80 bar. In particular preferred is a pressure of about 70 bar.

The infiltration temperature depends on the selection of the used metal. In case of e.g. aluminum, the infiltration temperature is about 800° C.

The method according to the present invention is preferably carried out in a pressure vessel which accommodates a preform with a porosity of 10% by volume to 30% by volume. In particular cases, the preform can have a porosity of 20% by volume to 25% by volume.

On occasion, the preform of reinforcement material is difficult to infiltrate with a selected metal in the presence of an oxygen or air environment. Thus, in accordance with another feature of the present invention, the infiltration and cooling steps are carried out in an inert atmosphere by introducing an inert gas, preferably a noble gas to purge the interior space of the pressure vessel of reactive gases.

Suitable materials for a preform include silicon carbide particles, aluminum nitride particles, silicone nitride particles, boron carbide or carbon fibers or ceramic fibers.

Suitable metals for use as infiltration metal include aluminum, magnesium, copper, silicon, iron or alloys thereof.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1A:
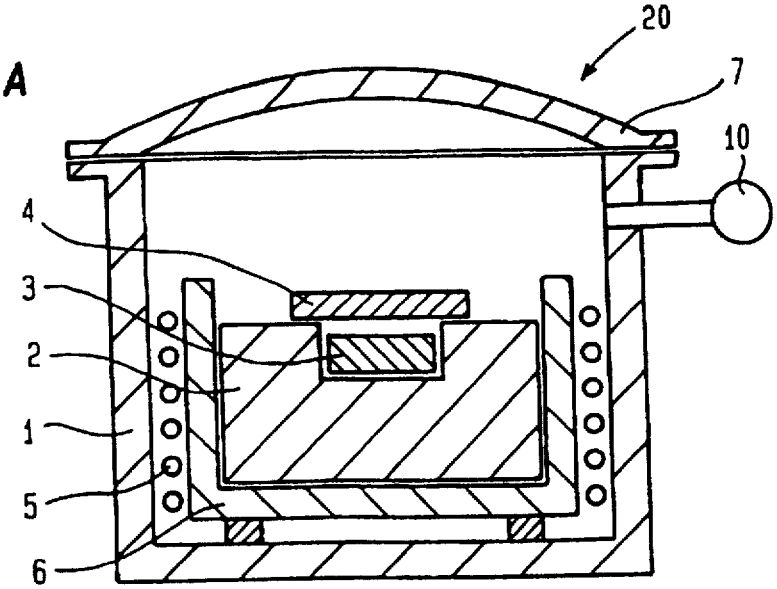
FIG. 1*a* shows a sectional view of one embodiment of an apparatus in form of a pressure vessel for making a MMC product, in accordance with the present invention.

Throughout all the figures, the same or corresponding elements are generally indicated by the same reference numerals.

Turning now to the drawing, and in particular to FIG. 1*a*, there is shown a sectional view of an apparatus for making MMC products, in accordance with the present invention, generally designated by reference numeral 20 and provided e.g. in form of a pressure vessel. The pressure vessel 20 includes a case 1 which defines an interior space and has an open top which is closeable by a lid 7. Placed into the interior space of the case 1 is a pan or crucible 6 which receives a mold 2 having an upper cavity of suitable configuration for receiving a preform 3. A heating unit 5 surrounds the crucible 6 in the space between the case 1 and the crucible 6.

The preform 3 is made of a suitable reinforcement material, selected from the group consisting of silicon carbide particles, aluminum nitride particles, silicon nitride particles, boron carbide, carbon fibers and ceramic fibers. The mold 2 can be made of a porous material to absorb gas escaping from the preform 3 at metal infiltration during the pressure treatment. Suitable materials for the mold 2 include graphite or porous ceramics. Alternatively, the mold 2 may also be made of steel or of gastight ceramics, e.g. aluminum titanate.

In vicinity of the lid 7, the interior space of the case 1 is connected to a pressure source 10 for supply of a pressure fluid. Opposing the preform 3 and resting upon the rim of the mold 2 is a block of feeder material 4 of fusible metal which upon heating melts and infiltrates into the preform 3. Suitable examples for infiltration metal include aluminum, magnesium, copper, silicon, iron and alloys thereof.

The method according to the present invention is carried out as follows:

After placing the preform 3 into the cavity of the mold 2, the case 1 is closed by the lid 7. The heating unit 5 is started and the interior space of the case 1 is pressurized via the pressure source 10. Thus, the block 4 of fusible metal melts and is pressed by the prevailing pressure inside the interior space onto the preform 3 to infiltrate or permeate into the preform 3. After termination of the infiltration of metal into the preform 3, the heating unit 5 is cut and the metal is allowed to solidify under pressure.

Figure 1B:
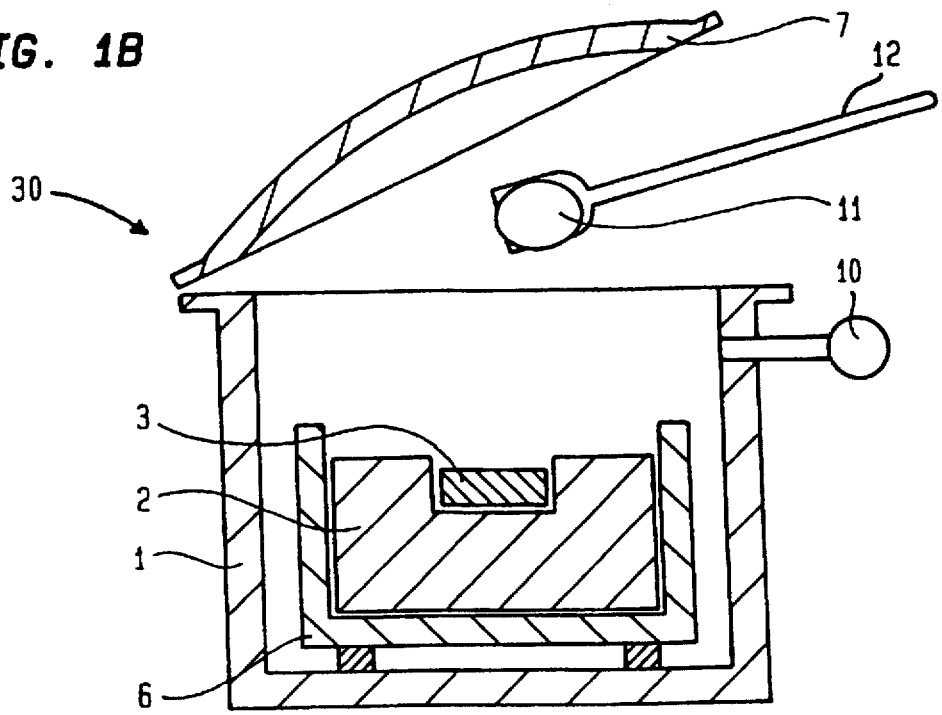
FIG. 1*b* is a sectional view of a second embodiment of an apparatus for making a MMC product, in accordance with the present invention.

FIG. 1*b* shows a sectional view of a second embodiment of an apparatus for making a MMC product, according to the present invention, generally designated by reference numeral 30 and provided e.g. in form of a pressure vessel. The pressure vessel 30 differs from the pressure vessel 20 by the omission of a heating unit and the omission of a block for release of metal. Instead of melting the metal inside the crucible 6, the metal, indicated at 11, is melted outside the pressure vessel 30 and poured onto the preform 3 by a suitable tool 12. After pouring the melted metal 11 upon the preform 3, the lid 7 is closed and the interior of the case 1 is pressurized via the pressure source 10 at a constant pressure to thereby press the liquid metal into the preform 3. Thereafter, the metal is allowed to solidify at the applied pressure.

Figure 2A:
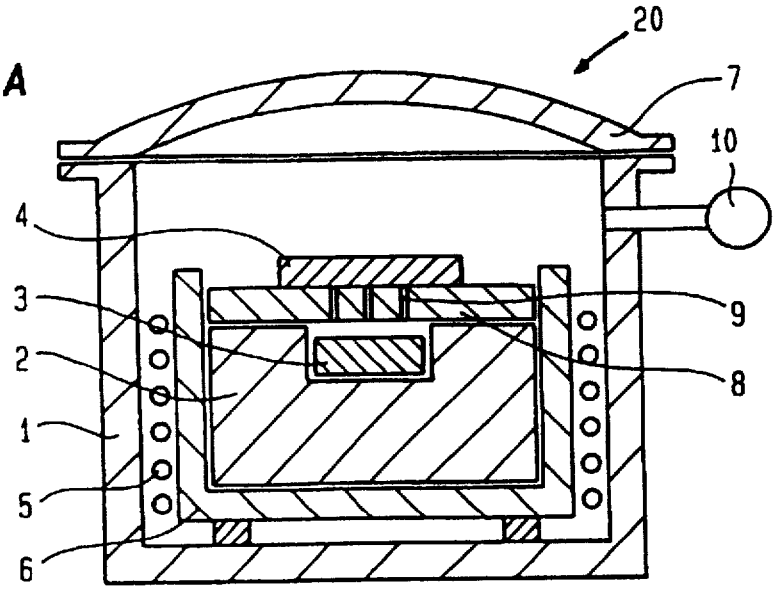
FIG. 2*a* is a sectional view of a modification of the apparatus according to FIG. 1*a*.

FIG. 2*a* shows a sectional view of a variation of the pressure vessel 20 which includes a covering 8 placed upon the mold 2 to separate the block of feeder material 4 of metal from the preform 3. The covering 8 is provided with vertical bores 9 in parallel relationship to provide a passageway for metal released by the block of feeder material 4 and the preform 3 received in the cavity of the mold 2. The crucible 6 surrounds the mold 2 including the covering 8 and the block of feeder material 4.

The operation is carried out in a similar manner as described with reference to FIG. 1*a*. After placement of the preform 3 into the cavity of the mold 2 and placement of the covering 8 over the preform 3, the block of feeder material 4 is positioned over the bores 9. Subsequently, the lid 7 is closed and the heating unit 5 is started. After reaching the melting temperature of the fusible metal, the metal permeates through the bores 9 onto the preform 3 and infiltrates the reinforcement material while the interior space of the case 1 is pressurized by the pressure source 10. After termination of the infiltration process, the metal is allowed to solidify under pressure.

Figure 2B:
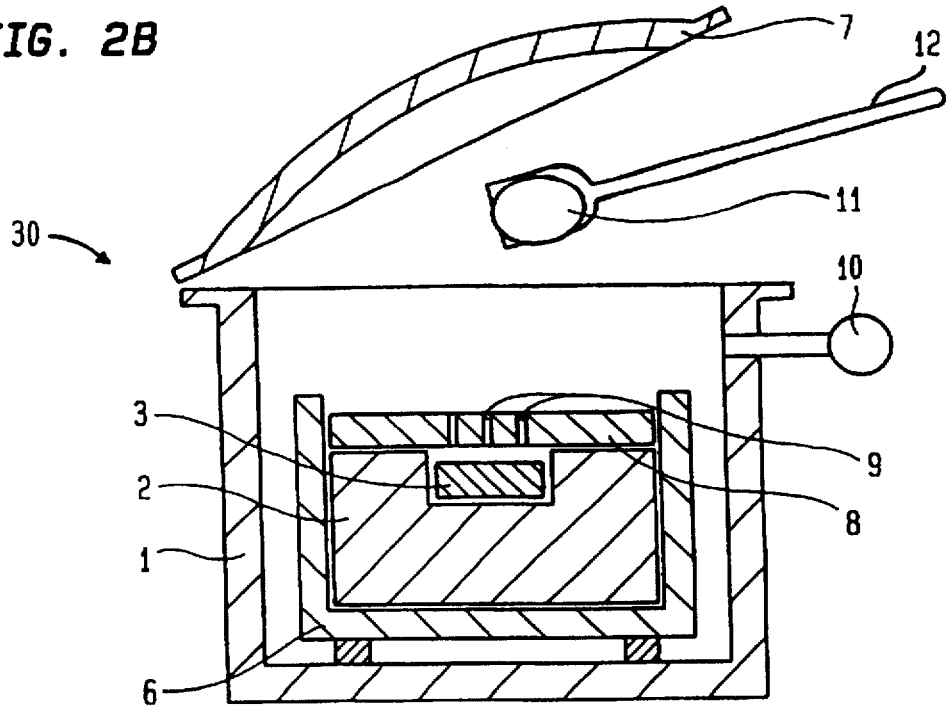
FIG. 2*b* is a sectional view of a modification of the apparatus according to FIG. 1*b*.

FIG. 2*b* shows a sectional view of a variation of the pressure vessel 30 without heating unit and feeder. In similar manner as the pressure vessel 20 according to FIG. 2*a*, the mold 2 is masked by a covering 8 which is provided with vertical bores 9 in parallel relationship. The metal 11 melted outside the pressure vessel 1 is poured by a suitable tool 12 onto the covering 8 and permeates through the bores 9 onto the preform 3. The lid 7 is then closed, and the interior space of the case 1 is pressurized by the pressure source 10 for pressing and infiltrating the metal into the preform 3 at a constant pressure. Thereafter, at closed lid 7 and pressurized conditions, the metal is allowed to solidify.

On occasion, the preform 3 of reinforcement material is difficult to infiltrate with a selected metal in the presence of an oxygen or air environment. Thus, in accordance with another feature of the present invention, the infiltration and cooling steps are carried out in an inert atmosphere by introducing an inert gas such as nitrogen, preferably a noble gas such as helium, from the pressure source 10 to purge the interior space of the pressure vessel of reactive gases.

While the invention has been illustrated and described as embodied in a method of and apparatus for making metal matrix composites, it is not intended to be limited to the details shown since various modifications and structural changes may be made without departing in any way from the spirit of the present invention.

What is claimed as new and desired to be protected by Letters Patent is set forth in the appended claims:

1. A method of making a metal matrix composite, comprising the steps of:

disposing a preform of reinforcement material in a mold for placement in a pressure vessel;

liquefying metal outside the pressure vessel;

infiltrating the preform with liquefied metal by subjecting the preform and the mold to a constant pressure above atmospheric pressure within the pressure vessel without preceding vacuum treatment of the preform; and allowing the preform with infiltrated metal to solidify at the constant pressure.

2. The method of claim 1 wherein said disposing step is effected in a mold of porous material which absorbs gas escaping from the preform during said infiltrating step.

3. The method of claim 1 wherein said disposing step is effected in a mold of a material selected from the group consisting of graphite and porous ceramics.

4. The method of claim 1 wherein said disposing step is effected in a mold of a material selected from the group consisting of steel and of gastight ceramics.

5. The method of claim 4 wherein said disposing step is effected in a mold of aluminum titanate.

6. The method of claim 4 wherein said disposing step includes using a mold at least partially made of a porous material.

7. The method of claim 1 wherein said infiltrating step includes applying a pressure of 60 bar to 140 bar.

8. The method of claim 7 wherein said infiltrating step includes applying a pressure of 60 bar to 80 bar.

9. The method of claim 8 wherein said infiltrating step includes applying a pressure of 70 bar.

10. The method of claim 7 wherein said infiltrating step includes using a preform with a porosity of 10% by volume to 30% by volume.

11. The method of claim 10 wherein said infiltrating step includes using a preform with a porosity of 20% by volume to 25% by volume.

12. The method of claim 1, further comprising the step of flushing the pressure vessel with inert gas during said infiltrating and cooling steps.

13. The method of claim 12 wherein said flushing step includes flushing the pressure vessel with noble gas.

14. The method of claim 1 wherein said infiltrating step includes providing a preform made of a material selected from the group consisting of silicon carbide particles, aluminum nitride particles, silicon nitride particles, boron carbide particles, carbon fibers and ceramic fibers.

15. The method of claim 1 wherein said infiltrating step includes providing an infiltration metal selected from the group consisting of aluminum, magnesium, copper, silicon, iron and alloys thereof.

* * * * *